US005228408A

United States Patent [19]

Jannausch

[11] Patent Number: 5,228,408

[45] Date of Patent: Jul. 20, 1993

[54] PROTECTIVE COVER ASSEMBLY FOR BOATS AND THE LIKE

[76] Inventor: Thomas L. Jannausch, 1487 Fieldstone Ct., Ann Arbor, Mich. 48108

[21] Appl. No.: 817,300

[22] Filed: Jan. 6, 1992

[51] Int. Cl.[5] ..... B63B 17/00

[52] U.S. Cl. ..... 114/361; 135/88; 135/114

[58] Field of Search ..... 150/166; 248/345; 114/361, 343, 349, 201 R, 203, 71; 135/87, 88, 90, 101-104, 106, 114, 115, 906, 907; 296/111

[56] References Cited

U.S. PATENT DOCUMENTS

| | | | |
|---|---|---|---|
| 2,390,986 | 12/1945 | Burns | 114/361 |
| 2,474,031 | 6/1947 | Burns | 114/361 |
| 2,764,765 | 10/1956 | Woodruff | 114/361 |
| 2,811,728 | 11/1957 | Litsheim | 114/361 |
| 3,106,218 | 10/1963 | Wright | 114/361 |
| 3,106,931 | 10/1963 | Cooper | 114/361 |
| 3,226,066 | 12/1965 | Folb | 114/361 |
| 3,896,832 | 7/1975 | Montoya | 114/361 |
| 4,075,723 | 2/1978 | Bareis | 114/361 |
| 4,672,910 | 6/1987 | Cook | 114/361 |
| 4,979,457 | 12/1990 | Sommerhausser | 114/361 |
| 4,995,329 | 2/1991 | Kleine | 114/361 |

*Primary Examiner*—Joseph F. Peters, Jr.
*Assistant Examiner*—Clifford T. Bartz

[57] ABSTRACT

A boat cover assembly includes a boat cover (12) mounted to a plurality of posts assemblies (28), (30), and (32). Each post assembly has a foot section (34) or (80), a post member (48), and a upper section (50). The upper section (50) has a batten member (64) mounted in a channel (56) and extending laterally into sleeves (65) sewn into the cover (12). The cover also has a chord (90) in the hem line (18) to tighten the cover about the boat hull (11) below its rub line (88). Straps (20) and (21) are secured to cover (12) and mounted about the underside (85) of the hull (11) and fastened together to secure the cover to the boat.

13 Claims, 5 Drawing Sheets

PROTECTIVE COVER ASSEMBLY FOR BOATS AND THE LIKE

TECHNICAL FIELD

This invention relates to boat covers and more particularly to boat cover assemblies for outdoor storage.

BACKGROUND OF THE INVENTION

Protection of boats against the elements of weather during winter storage has had several problems associated with it. Indoor storage inside a shed or hanger is very expensive due to the limited amount of indoor sites available and consequently the high rents commanded by the market place. On the other hand, outdoor storage requires a cover for the boat to prevent snow, ice, and water from damaging the boat during storage. Tarpaulins have not been wholly successful due to unsupported sections of the tarpaulin accumulating ice, water and debris.

The concept of shrink wrapping plastic about the top side of the boat has been developed. A heat-shrinkable plastic film is draped over the boat deck and heat from a blow dryer is then applied to the plastic to shrink it tight about the rub line below the deck and over the deck. The shrinking of the plastic to a tight fit prevents any sunken portions forming in the plastic and thereby prevents water from pooling thereon.

The plastic film however has inherent weakness against any storm or severe wind which may tear the plastic film itself. The film is also subject to puncture from any pointed object such as a broken branch, pointed stone, or flying glass. Furthermore, at the end of the storage period the plastic bulky shrink wrap must be properly disposed of. The shrink wrap is only usable once and each year another shrink wrap must be purchased and installed.

Pole structures have also been devised to support the tarpaulin along the center line of the boat. These poles are often inserted through a grommet in the tarpaulin fabric. While these tent pole devices are suitable for small boats with relatively small beams, tarpaulins installed over larger beamed boats with only a center support still sag to form low points for collection of water. The tarpaulins and shrink wrap installed on larger boats are commonly supported by home-made haphazard structures made from pieces of lumber secured together to form a frame above the deck onto which the tarpaulin or shrink wrap is placed.

What is needed is a reusable boat cover assembly that has a durable tarpaulin cover that is draped over a center line support which provides the cover with an arch to drain water therefrom.

SUMMARY OF THE DISCLOSURE

In accordance with one aspect of the invention, a flexible protective cover is fastened to a resilient archable batten member of a post assembly. The post assembly has a foot section mountable on a deck of a boat and a post upwardly extending from the foot section at a midline of the boat. The archable batten member extends laterally from the top of the post member toward the sides of the boat. The archable batten member is desirably fitted into a sleeve at the inside surface of the cover and is supported near or at a midpoint by the post.

Preferably, the post assembly includes a channel member mounted at a top end thereof. The channel member has a channel sized to receive a mid-section of the archable batten member. A fastener retains the archable batten member in the channel. In one embodiment, the foot section includes a base member and two side members that are telescopically connected to the base member. The base member supports the upwardly extending post member. The side members extend laterally toward the two opposite sides of the boat. Each side member has a groove at a distal end constructed to laterally receive a side rail post of the boat. A fastener affixes each side member to the base member at a selected one of a plurality of adjusted positions.

In another embodiment, the post member is mounted onto a foot section that is contoured to seat flush against the mid-line of the boat deck. The foot member preferably has four feet circumferentially spaced about the post with two feet positioned at the mid-line of the boat and two contoured feet laterally spaced therefrom. According to another aspect of the invention, a post assembly for a protective boat cover includes a foot section for engagement to the boat deck, a post upwardly extending therefrom at the mid-line of the boat, and an upper section constructed for supporting a flexible protective cover that is sized to cover the deck of the boat. Preferably, the foot section includes two laterally extending sections that laterally engage the side rail posts of the boat deck. Preferably the upper section includes a resilient semi-flexible archable supportive member that is fastenable to the cover and supports the cover over the boat.

In accordance with another aspect of the invention, the boat cover has a plurality of straps extending from a periphery thereof. One strap is longitudinally aligned with another strap to form a pair that can extend under and about the boat hull. Each strap of each pair has a fastener mechanism at its distal end to fasten the straps together.

In this fashion, a reusable tarpaulin cover is mounted onto a boat deck and is supported for drainage and protection against wind and storm.

BRIEF DESCRIPTION OF THE DRAWINGS

The invention will now be described with reference to the accompanying drawings in which.

DETAILED DESCRIPTION OF THE PREFERRED EMBODIMENT

Figure 1:
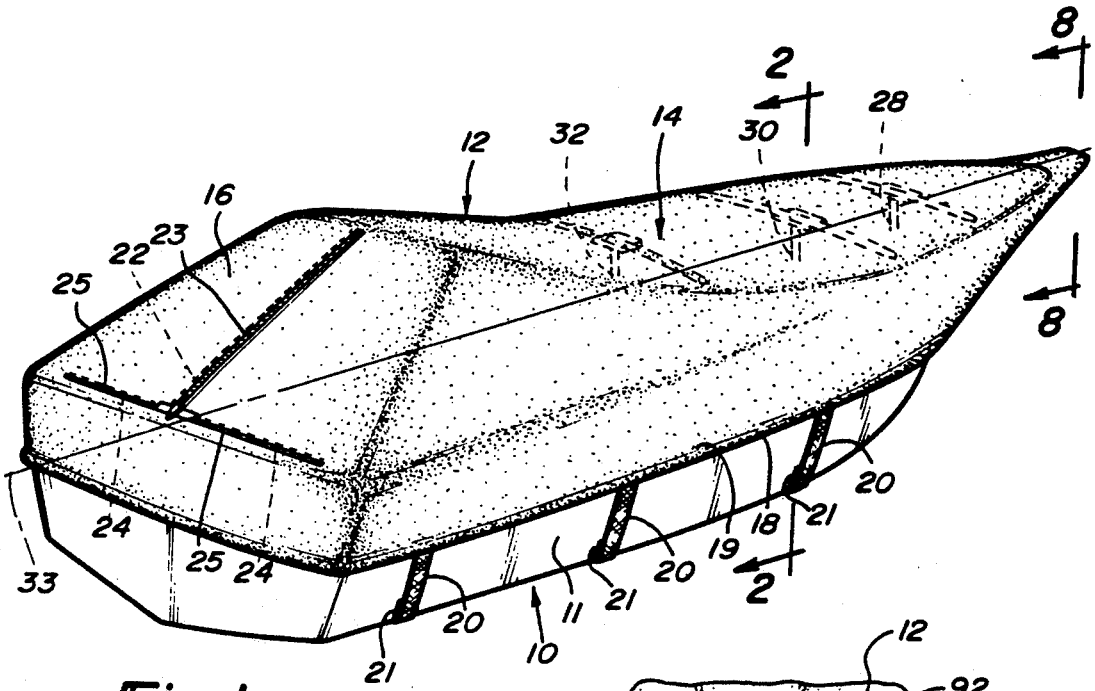
FIG. 1 is a top rear perspective view of protective cover assembly according to the invention installed onto a boat.
Figure 2:
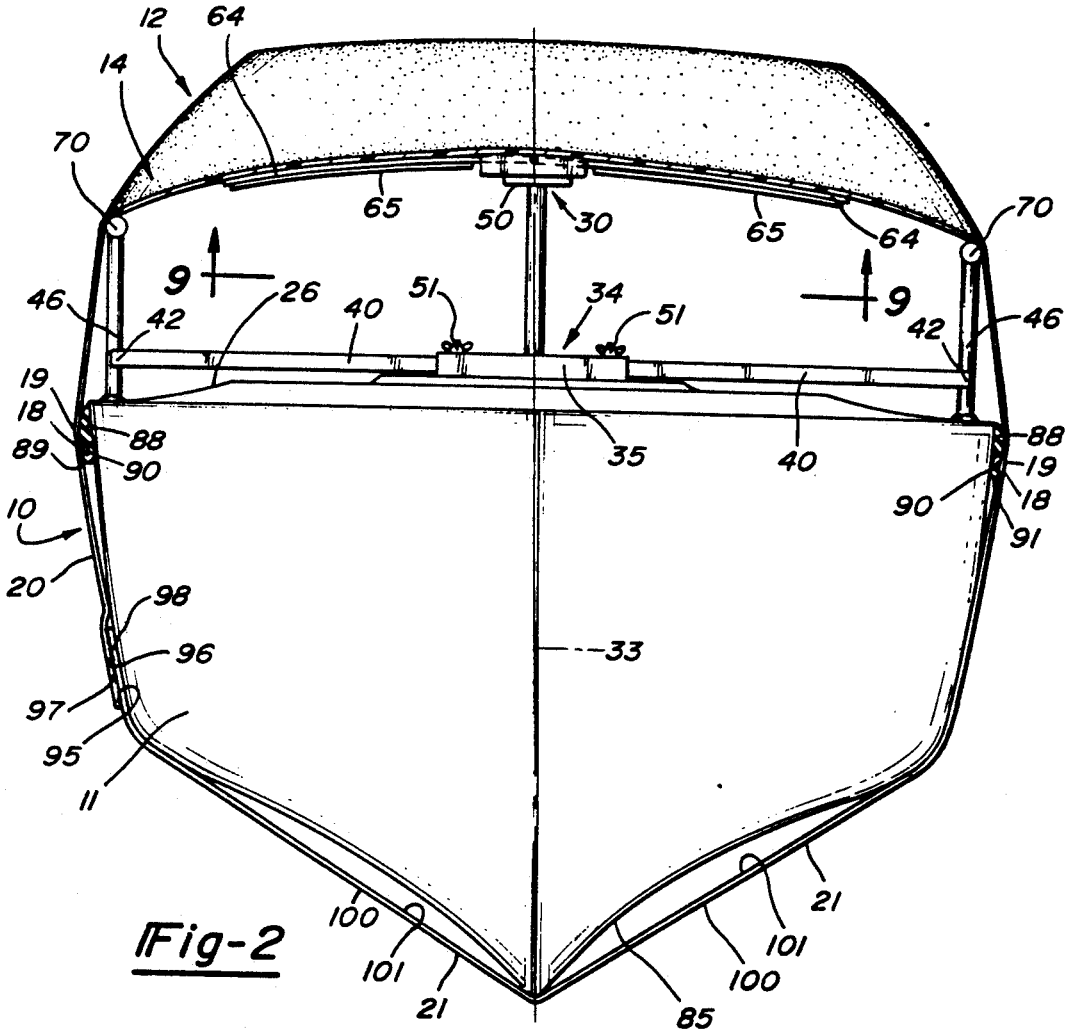
FIG. 2 is partially segmented view taken along line 2—2 shown in FIG. 1.

Referring to FIGS. 1 and 2, a boat 10 with a hull 11 and deck 26 has a boat cover 12 installed thereon. The boat cover 12 has a front canopy section 14, a rear entry section 16, a periphery 19 having a hem 18, and securement straps 20 and 21. The entry section 16 has a vertical zipper 22 and two horizontal zippers 24 that can open up to the boat deck 26. The zippers 22 and 23 may be protected by flaps 23 and 25 integrally formed with the cover material. The cover material may be a canvas type material that is commercially available. Boatex "A", Aqualon, or Maritime fabrics by the Astrup Company are suitable materials. Other suitable materials include Dickosea or Roadstar 18 by Dickson Constant.

The front canopy section 14 is supported by a plurality of post assemblies 28, 30, and 32 positioned along the center line 33 of the boat 10. As shown more clearly in FIGS. 2-5, the post assembly 30 has foot section 34 that supports the post assembly upright. The foot section 34 includes a center base section 35 that has a central aperture 36 for receiving a post 48 and two side apertures 38 that telescopically receive two side bars 40. Each side bar 40 has a distal end 42 having a notch 44 that engages a rail post 46 mounted on the boat deck 26. The side bars 40 are positioned such that end notch 44 engages rail post 46. The notch 44 is preferably V-shaped to accommodate rail posts of different diameters. The side bar is then affixed to the center base section 35 via tightening of a butterfly nut 51 threaded onto a bolt fastener 52 that extends through a slot 53 in bar 40 and aperture 49 in base section 35.

An upper section 50 is mounted at the top of post 48. The upper section has a hole 54 that receives the upper end 55 of post 48. The upper section 50 has a channel 56 with a canted floor 58 that slopes downwardly from center line 33. Side walls 60 have a top edge 61 that is also sloped downwardly from center line 33. The walls 60 at a midsection thereof have a pin receiving aperture 62 extending therethrough at center line 33. The channel 50 is open at its top face.

Figure 4:
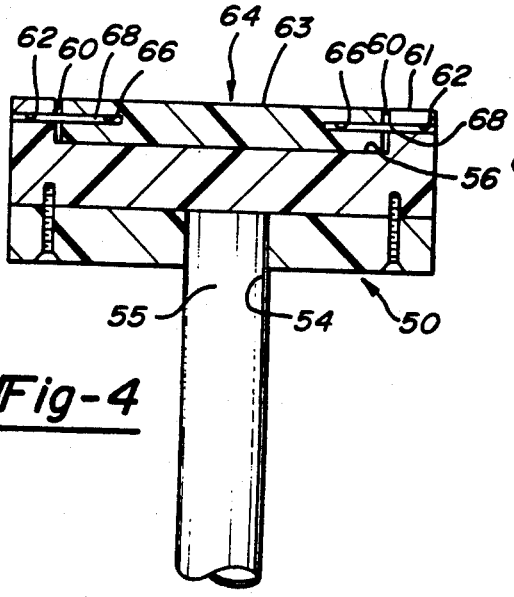
FIG. 4 is a cross-sectional view taken along lines 4—4 shown in FIG. 3.
Figure 3:
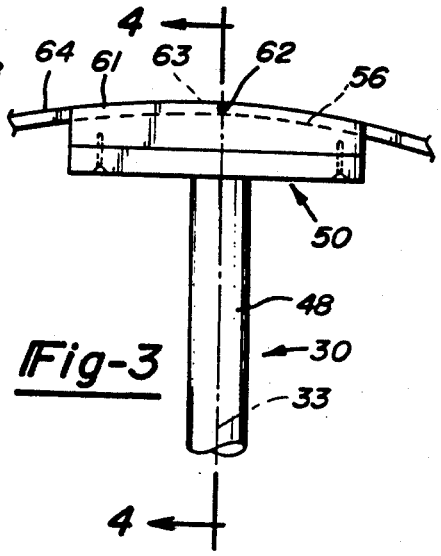
FIG. 3 is an enlarged fragmentary view of the upper section of the post assembly illustrated in FIG. 2.

A resilient semi-flexible archable batten member 64 is positioned and affixed at its midsection 63 to the upper section 50 within channel 56. The batten member 64 has two laterally extending holes 66 that are alignable to the apertures 62. Pins 68 are insertable in apertures 62 and holes 66 to mount the archable batten member 64. The archable batten member 64 extends laterally from the channel 56 toward the side rail 70 mounted on rail posts 46. The archable batten member 64 has a substantially rectangular cross-section as shown in FIG. 4 such that its width is substantially greater that its thickness. This construction provides that the most of the resilient flexibility of the batten is in the vertical direction as indicated in FIG. 3. The open face of channel 50 allows for the batten to flex in a vertical direction within channel 50.

Figure 9:
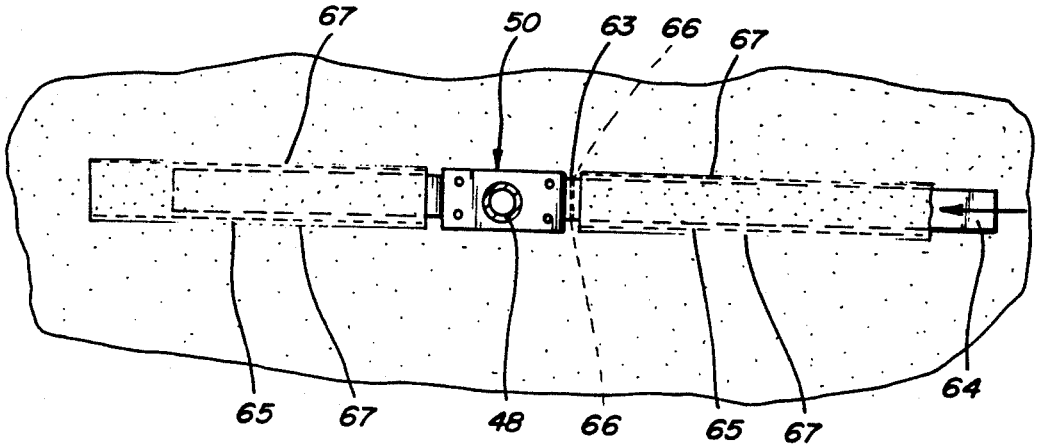
FIG. 9 is a fragmentary bottom elevational view taken along lines 9—9 shown in FIG. 2 illustrating assembly of the batten member to the cover and post assembly.
Figure 10:
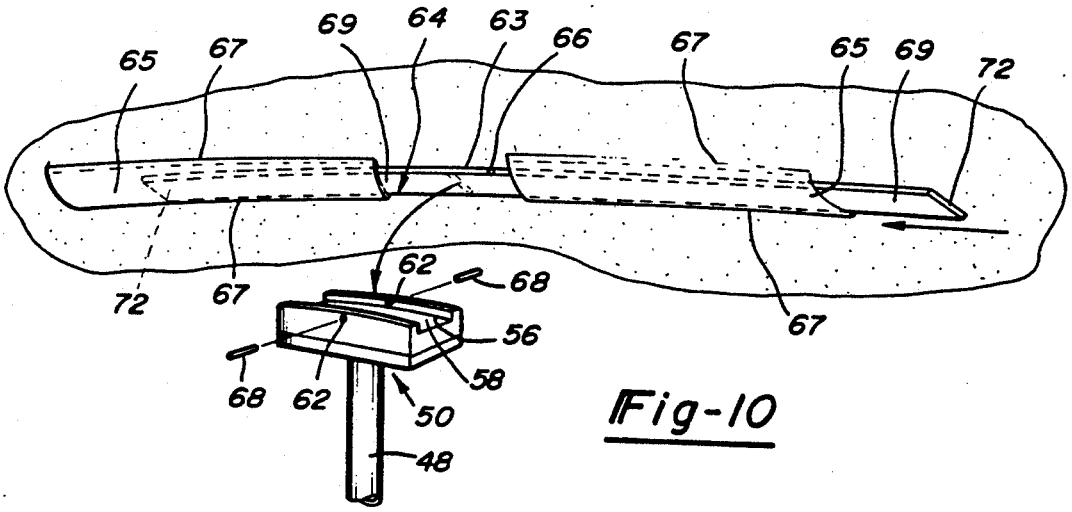
FIG. 10 is a perspective view of FIG. 9.

Referring to FIG. 2, 9, and 10, the archable batten member 64 extends through two pockets or sleeves 65 sewn into the underside of the cover 12. The sleeves 65 are sewn into canopy section 14 along seams 67. The width of sleeve 65 is sized to snugly receive the battens 64. The sleeve 65 also extends a substantial length along the batten 64 on each half section 69. The weight and tension exerted by the cover 12 arches the archable batten member 64 such that its distal ends 72 are bent downwardly. The archable batten member 64 is made from a high density polycarbonate such that when the member 64 arches downwardly it produces an upwardly directed bias that supports the weight of the cover 12.

The foot section 34 stabilizes the post 48, upper section 50 and archable member 64 by bracing the post assembly 30 at the center line 33. The post assembly 28 is identical to post assembly 30 and is positioned longitudinally at another pair of side rail posts 46. The post assemblies 28 and 30 are used wherever a pair of side rail posts 46 can be engaged by the notches 44 in side bars 40.

Figure 7:
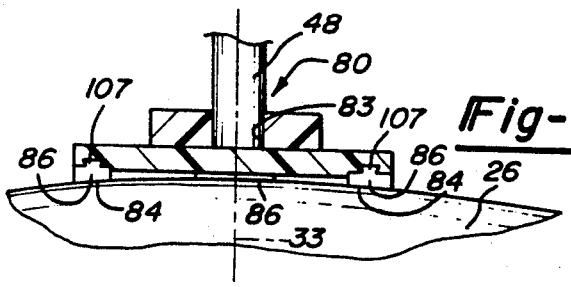
FIG. 7 is cross-sectional view of the foot section of the post assembly taken along lines 7—7 shown in FIG. 6.
Figure 5:
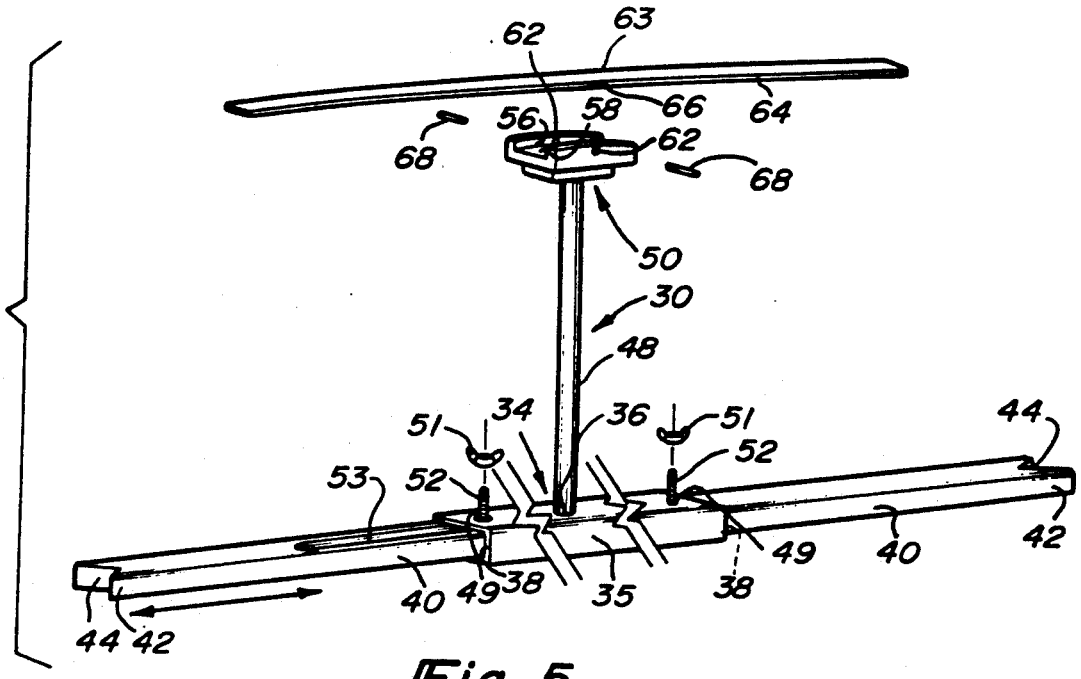
FIG. 5 is a perspective and partially exploded view of the post assembly illustrated in FIG. 2.
Figure 6:
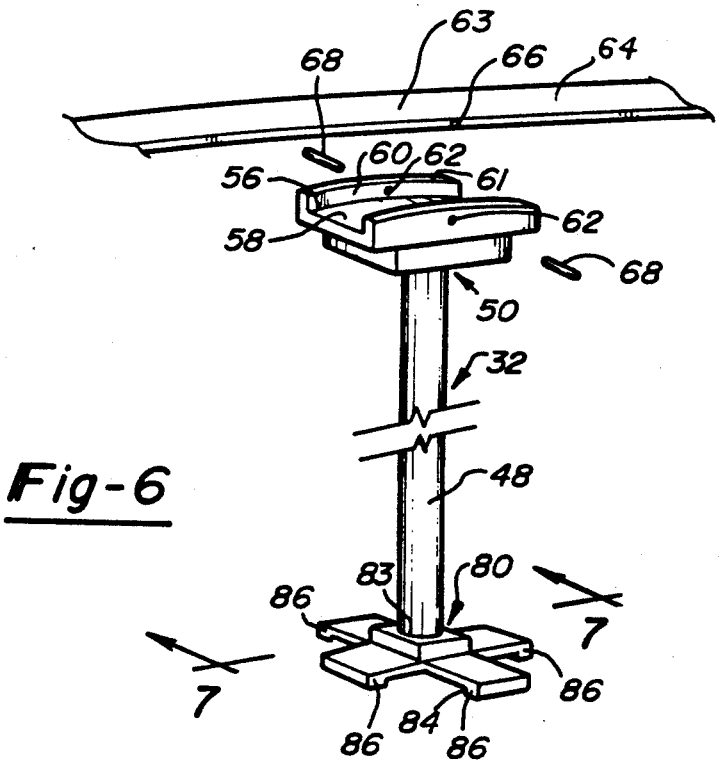
FIG. 6 is a perspective and partially exploded view of a alternate embodiment of the post assembly.

Under certain circumstances, the post assemblies 28 and 30 are not usable. For example, no side rail 70 or side rail post may be present at that section of the boat or alternatively, obstacles on the boat deck may prevent the side bars 40 from extending from the center line 33 to the side rail post 46. Under these circumstances, an alternate post assembly 32 is used. Post assembly 32 is more clearly shown in FIGS. 6 and 7. The foot section 80 has a center section 82 that has an aperture 83 that receives the post 48. The bottom section is made from a rigid high density plastic that will not mar the boat deck. The bottom surface 84 of the foot section 80 is contoured to conform to the lateral convex contour of the boat deck 26. The contour is most commonly a concave arc to complement the convex arc of the boat deck that extends from one side rail to an opposing side rail at an opposite side of the boat deck 26. The shape of the bottom surface 84 from front to back is substantially flat to conform to the substantially flat contour of the deck 26 from bow to stern.

Figure 11:
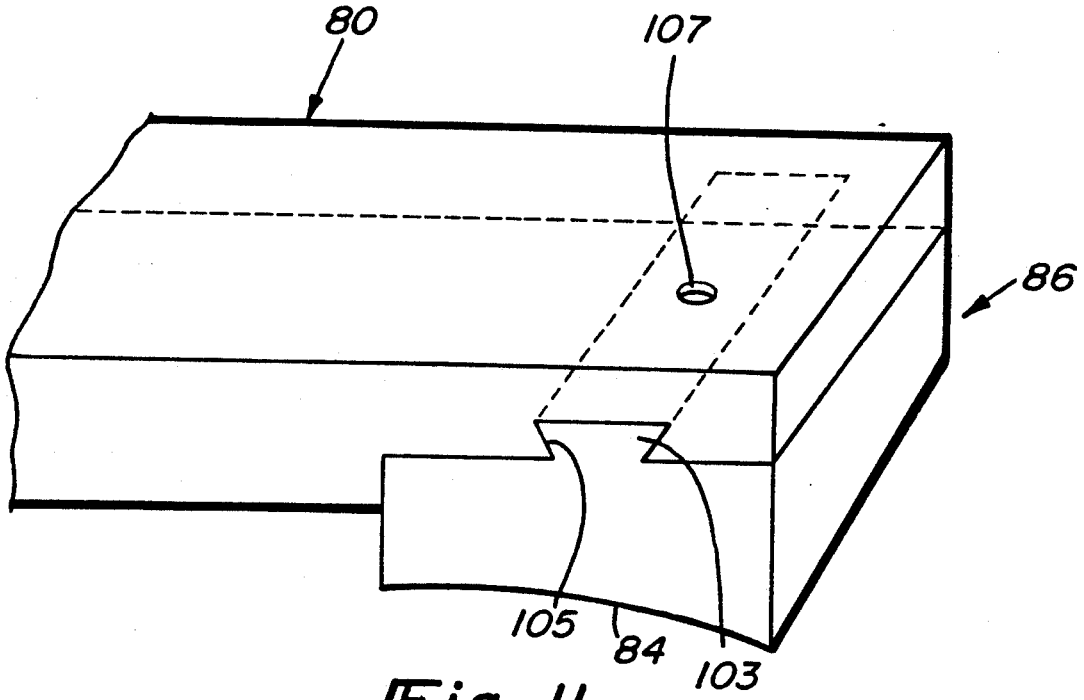
FIG. 11 is an enlarged fragmentary view of a foot pad shown in FIG. 6.
Figure 12:
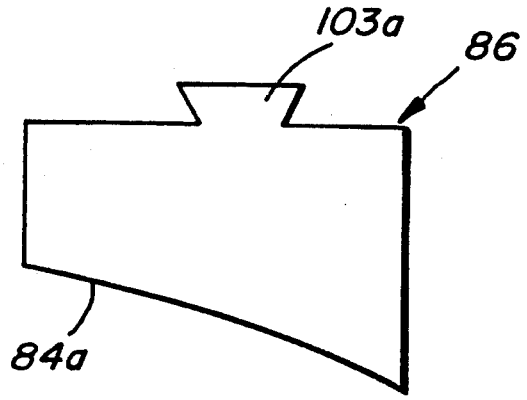
FIG. 12 is a side elevational view illustrating an alternate foot pad for a different boat deck.

The bottom surface may have four foot pads 86 spaced from post 48 and circumferentially spaced thereabout. The foot pad 86 is clearly shown in FIG. 11 having a bottom contour 84. The pad 86 has an upper under cut flange 103 that slideably fits within and undercut groove 105 in foot section 80. A set screw 107 fixes the foot pad 86 in position. An alternate foot pad 86*a* is shown in FIG. 12 that has a different bottom contour 84*a* to conform to a different deck contour or cord line. The appropriate foot pad is chosen to provide that the post assembly 32 flushly stands on deck 26.

Figure 8:
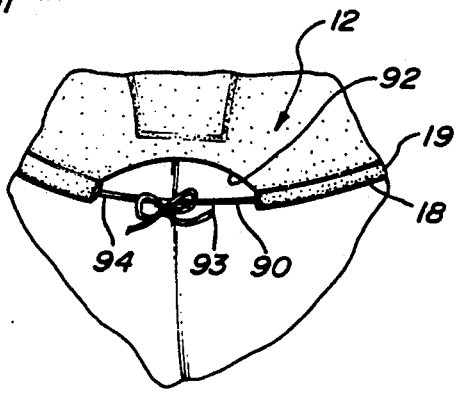
FIG. 8 is a fragmentary front elevational view of the boat cover assembly taken along lines 8—8 shown in FIG. 1.

The cover 12 is placed over the post assemblies 28, 30, and 32 and over the side rail 70 to cover the entire deck 26. The cover 12 extends over the bumper 88 which extends substantially about the entire hull 11 and is often referred to as the rub line. The periphery 19 includes hem 18 which has a tie chord 90 passing therethrough. The front of the cover 12 has a notch 92 as shown in FIG. 8 where the left and right ends 93 and 94 of the chord 90 are exposed and can be tied or otherwise fastened together such that hem 18 is tightened about hull 11 below rub line 88. For clarity the terms "left" and "right" are in reference to the boat 10 and the cover 12 when installed on the boat.

The cover 12 is also secured onto the boat 10 by straps 20 and 21 which have one end 89 and 91 respectively attached to the hem 18 at both left and right sides respectively of the cover periphery 19. A strap 20 on the right side is aligned with a strap 21 on the left side such that pairs of aligned straps are formed. Each pair has a fastener attachment mechanism 95 and 96 attached to a distal end 97 and 98 respectively such that one strap is wrapped about the underside 85 of hull 11 of the boat and is fastened to its complementary strap and fastened thereto. One suitable fastening mechanism for distal ends 97 and 98 is a Velcro type system, commonly referred to as a hook and loop fastener or intermeshing locking material.

The right straps 20 may be shorter than the left straps 21 as shown in FIG. 2 such that the fastening position is at one side of the boat hull 11 such that an installer can easily access and fasten the straps together without the necessity of crawling or bending under the boat. Each strap is flat with relatively wide inner and outer surfaces 100 and 101 respectively compared to its thickness such that the straps 20 and 21 risk of marring the boat hull 21 is reduced.

The tie chord 90 provides that the hem 18 is snugly fitted about the hull 11 of the boat 10 to provide weather resistant connection to the boat. The straps 20 and 21 provides additional securement of the cover 10 onto the deck to be resistant against the elements of weather such as wind and rain. The post assemblies provides tension of the cover which in turn provides for proper sloping of the cover and for proper drainage of the tarpaulin section when snow and rain fall.

The protected zippers 22 and 24 provide for entry into the boat 10 after the cover 10 is installed onto the boat. The archable batten members 64 provide for proper sloping of the canopy section 14 and prevents pockets of water or ice to form on the cover 12. Furthermore the sleeves 65 prevent the cover 12 from lifting and separating from the anchored batten member 64 such that the cover is secured onto the boat. The tightened hem line 18 under rub line 88 also secures the cover against separating from the boat. The post assemblies that hold the archable batten member 64 are easily installed and retained in place by either foot section 34 or alternate foot section 80. In this fashion a weather resistant protective cover assembly is provided that is reusable, is easily installed, is easily disassembled, and allows entry to the boat during storage.

Variations and modifications of the present invention are possible without departing from its scope and spirit as defined in the appended claims.

What is claimed is:

1. A protective cover assembly for a boat characterized by:

a plurality of post assemblies with each post assembly longitudinally spaced along a mid-line of said boat from each other and each post assembly having a foot section and a upright support post positionable at a mid-line of said boat and having at its upper end a laterally extending resilient semi-flexible archable batten member extendable toward opposite sides of the boat;

said archable batten being constructed with its width substantially greater than its thickness and positioned such that most of the resilient flexibility of the batten is substantially in the vertical direction; and a flexible cover supported on said archable batten member and having a peripheral edge with a fastener mechanism to fasten the cover about a hull of the boat.

2. A protective cover assembly as defined in claim 1 further characterized by:

said batten member being supported at a midsection by said support post; and said flexible cover having a pair of sleeves on an interior side thereof which receive said archable batten member at each side of said midsection.

3. A protective cover assembly as defined in claim 2 further characterized by:

said support post includes a channel member mounted at a top end thereof;

said channel member has a channel sized for receiving said mid-section of said archable batten member;

said channel having an open top to allow said mid-section of said batten member within said channel to vertically flex; and a fastener for securing said midsection of said archable member within said channel of said channel member.

4. A protective cover assembly as defined in claim 3 further characterized by:

said foot section including a center base member and two side members that are telescopically connected to said base member and extend laterally toward the opposite sides of said boat;

each of said side members having distal ends with a notch therein to laterally receive a side rail post of said boat; and lock fasteners affixing each of said side members to said center base member in a selected one of a plurality of adjusted positions.

5. A protective cover assembly as defined in claim 4 further characterized by:

said flexible cover having a hem extending about said periphery thereof and with a tie chord extending through said hem for tieing said periphery snugly about the hull of the boat when said cover is positioned over said boat with said hem positioned about said hull;

said cover having a notch in said hem where said chord is exposed at its opposite ends that can be fastened together.

6. A protective cover assembly as defined in claim 5 further characterized by:

said cover having straps extending laterally from said periphery on opposite sides of said cover and aligned axially in pairs;

each of said pairs of straps having fastener elements to fasten said straps together about an underside of said hull of said boat.

7. A protective cover assembly as defined in claim 6 further characterized by:

said fastener elements of said strap being intermeshing material that is secured to each strap, said intermeshing material on each strap engages each other to removably couple together said straps.

8. A protective cover assembly as defined in claim 3 further characterized by:

said foot section being constructed to rest on said deck of said boat hull and having a lower surface that is contoured laterally to complement the contour of the deck section on which the foot section is seated.

9. A protective cover assembly as defined in claim 8 further characterized by:

said foot section having a post receiving section and having four feet laterally extending from said post receiving section with two of the feet on radially opposite sides of said post receiving section and having a bottom surface that is contoured in a concave fashion to rest flushly on a convex deck surface of said boat.

10. A protective cover assembly as defined in claim 9 further characterized by:

said foot section having a separable foot pad member that is affixable thereto; and said lower surface being on said foot pad.

11. A post assembly for a protective boat cover characterized by:

a foot section with side distal ends engageable with a side rail post of a boat and having an post positionable along a longitudinal center line of said boat, said post having an upper section constructed to support a flexible cover that is sized to cover a deck of said boat; and each of said distal ends having an outwardly facing horizontally disposed notch therein to laterally receive a vertically disposed side rail post of said boat at each distal end with said foot section interposed between said side rail posts.

12. A protective cover assembly as defined in claim 11 further characterized by:

said notches being v-shaped.

13. A protective cover assembly for a boat characterized by:

at least one post assembly having a foot section and a upright support post positionable at a mid-line of said boat and having at its upper end a laterally extending resilient semi-flexible archable batten member extendable toward opposite sides of the boat;

a flexible cover supported on said archable batten member and having a peripheral edge with a fastener mechanism to fasten the cover about a hull of the boat;

said batten member being supported at a midsection by said support post;

said flexible cover having a pair of sleeves on an interior side thereof which receive said archable batten member at each side of said midsection;

said foot section including a center base member and two side members that a telescopically connected to said base member to extend laterally to the side of said boat;

each of said side members having distal ends with an outwardly facing notch therein to laterally receive a side rail post of said boat at each end with said foot section interposed between said side rail posts;

lock fasteners affixing each of said side members to said center base member in a selected one of a plurality of adjusted positions.

* * * * *